US005829276A

United States Patent [19]

Suh et al.

[11] Patent Number: 5,829,276

[45] Date of Patent: Nov. 3, 1998

[54] WASHING MACHINE EQUIPPED WITH PULSATOR TO PREVENT ENTANGLEMENT OF LAUNDRY

[75] Inventors: Byoung Sun Suh; Dong Soo Gil, both of Seoul, Rep. of Korea

[73] Assignee: LG Electronics Inc., Rep. of Korea

[21] Appl. No.: 842,203

[22] Filed: Apr. 23, 1997

[51] Int. Cl.[6] ..... D06F 17/00

[52] U.S. Cl. ..... 68/53; 68/134; 68/23.5; 68/207

[58] Field of Search ..... 68/23.5, 4, 134, 68/207, 53

[56] References Cited

U.S. PATENT DOCUMENTS

| | | | |
|---|---|---|---|
| 1,573,640 | 2/1926 | Fisher et al. | 68/4 |
| 1,605,412 | 11/1926 | Williams | 68/4 |
| 2,345,185 | 3/1944 | Edgar | 68/4 |
| 2,549,677 | 4/1951 | Egerton | 68/4 |
| 2,727,379 | 12/1955 | Colston | 68/53 |
| 2,882,706 | 4/1959 | Brucken | 68/23.5 |
| 4,653,294 | 3/1987 | Akinaga | 68/207 |
| 5,161,394 | 11/1992 | Felzer et al. | 68/207 |
| 5,421,174 | 6/1995 | Kim et al. | 68/134 |
| 5,595,072 | 1/1997 | Bai et al. | 68/207 |

FOREIGN PATENT DOCUMENTS

| | | | |
|---|---|---|---|
| 548379 | 6/1956 | Belgium | 68/134 |
| 195880 | 2/1958 | Germany | 68/53 |
| 1112040 | 8/1961 | Germany | 68/53 |
| 63-32478 | 6/1988 | Japan | 68/134 |
| 2-274285 | 11/1990 | Japan | 68/134 |

*Primary Examiner*—Frankie L. Stinson
*Attorney, Agent, or Firm*—Ostrolenk, Faber, Gerb & Soffen, LLP

[57] ABSTRACT

An improved washing machine equipped with a pulsator to prevent entanglement of laundry capable of efficiently preventing entanglement of laundry by preventing clothes being washed from gathering at the central portion in the inner tub of the washing machine, which includes an upper blade having a upwardly extending ejection hole, the upwardly extending ejection hole being formed at a central portion of the upper blade; a lower blade disposed below the upper blade; an improved pulsator disposed between the upper blade and the lower blade for transferring a driving force from the lower blade to the upper blade and having a plurality of spaced-apart support bushings for forming a washing water flow path between the upper blade and the lower blade; and an inner tub having a washing water guide section formed at a periphery of the lower blade and the support bushings.

4 Claims, 6 Drawing Sheets

WASHING MACHINE EQUIPPED WITH PULSATOR TO PREVENT ENTANGLEMENT OF LAUNDRY

BACKGROUND OF THE INVENTION

1. Field of the Invention

The present invention relates to a washing machine equipped with a pulsator to prevent entanglement of laundry, and in particular to an improved washing machine equipped with a pulsator to prevent entanglement of laundry capable of efficiently preventing entanglement of laundry by preventing clothes being washed from gathering at the central portion in the inner tub of the washing machine.

2. Description of the Conventional Art

Referring to FIG. 1, the conventional washing machine equipped with a pulsator includes a washing machine body 1. A motor 2 and a clutch 3 are provided at a predetermined portion of the washing machine body 1. An outer tub 4 is provided in the washing machine body 1 and above the motor 2 and the clutch 3. An inner tub 5 having a plurality of holes formed on its circumferential surface is provided inside the outer tub 4. The inner tub 5 is rotatable about the outer tub 4 by receiving a driving force from the motor 2 and the clutch 3. A pulsator 9 is rotatably provided at the bottom of the inner tub 5. Here, the pulsator 9 rotates in the reverse direction or in the normal direction in accordance with a certain driving mode of the motor 2 and the clutch 3.

In addition, the inner tub 5 is supported by an inner support frame 10 having a plurality of supports.

Meanwhile, a pulsator rotary shaft 11 is connected between the pulsator 9 and the clutch 3, passing through predetermined portions of the inner supporting frame 10 and the bottom of the inner tub 5.

The operation of the conventional washing machine equipped with a pulsator will now be explained with reference to FIG. 1.

To begin with, when the washing machine is driven in a state that laundry is input in the inner tub 5, the pulsator 9 rotates in the reverse direction or in a normal direction for a predetermined time by receiving a driving force from the motor 2 and the clutch 3, so that the laundry in the inner tub 5 is washed and rinsed in accordance with a certain operation mode.

During the washing operation, washing water (containing detergent and water) in the inner tub 5 makes a certain flow by the force of the pulsator 9. At this time, the laundry in the inner tub 5 gathers at the center portion of the inner tub 5, causing entanglement itself because the washing water in the inner tub 5 and the washing water in the outer tub 4 first forcibly go up along the inner circumferential surface of the inner tub 5 rather than the washing water in the inner tub 4.

Therefore, during the washing operation, the laundry in the inner tub becomes entangled due to a cross flow of washing water which is caused by a certain rotation of the pulsator.

SUMMARY OF THE INVENTION

Accordingly, it is an object of the present invention to provide a washing machine equipped with a pulsator to prevent entanglement of laundry, which overcome the problems encountered in the conventional washing machine equipped with a pulsator.

It is another object of the present invention to provide an improved washing machine equipped with a pulsator to prevent entanglement of laundry capable of efficiently preventing entanglement of laundry by preventing clothes being washed from gathering at the central portion in the inner tub of the washing machine.

To achieve the above objects, in accordance with a first embodiment of the present invention, there is provided a washing machine equipped with a pulsator to prevent entanglement of laundry, which includes an upper blade having a upwardly extending ejection hole, the upwardly extending ejection hole being formed at a central portion of the upper blade; a lower blade disposed below the upper blade; an improved pulsator disposed between the upper blade and the lower blade for transferring a driving force from the lower blade to the upper blade and having a plurality of spaced-apart support bushings for forming a washing water flow path between the upper blade and the lower blade; and an inner tub having a washing water guide section formed at a periphery of the lower blade and the support bushings.

To achieve the above objects, in accordance with a second embodiment of the present invention, there is provided a washing machine equipped with a pulsator to prevent entanglement of laundry, which includes an upper blade having a upwardly extending ejection hole, the upwardly extending ejection hole being formed at a central portion of the upper blade; a lower blade disposed below the upper blade; an improved pulsator disposed between the upper blade and the lower blade for transferring a driving force from the lower blade to the upper blade and having a plurality of spaced-apart support bushings for forming a washing water flow path between the upper blade and the lower blade; an inner tub having a washing water guide section formed at a periphery of the lower blade and the support bushings; and a pump disposed at a predetermined portion of the inner tub for pumping washing water to the ejecting hole.

To achieve the above objects, in accordance with a third embodiment of the present invention, there is provided a washing machine equipped with a pulsator to prevent entanglement of laundry, which includes an upper blade having an ejecting hole formed at its central portion; a lower blade disposed below the upper blade; a plurality of support bushings disposed between the upper blade and the lower blade for connecting the upper and lower blades and for transferring a driving force from the lower blade to the upper blade and spaced apart so as to form an upper portion washing water flow path between the upper blade and the lower blade; and a washing water flow section formed at a lower portion of an outer periphery of the upper blade and extended to a lower central portion of the lower blade; wherein the pulsator includes a plurality of ribs integrally formed with the lower surface of the washing water flow section extending from the outermost lower portion of the upper blade and the inner end portion of the washing water flow section.

DETAILED DESCRIPTION OF THE INVENTION

Figure 1:
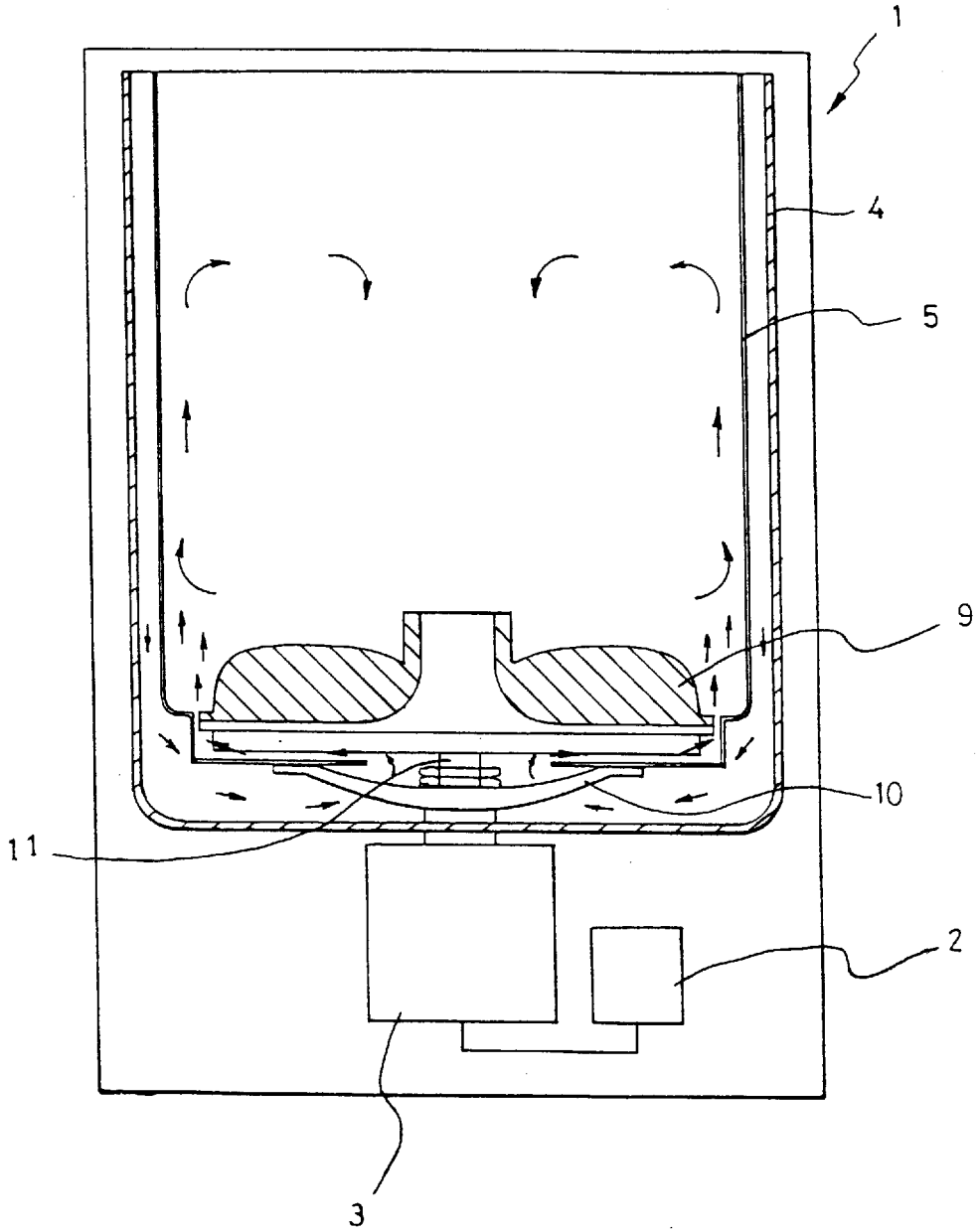
FIG. 1 CONVENTIONAL ART
FIG. 1 is a cross-sectional view showing a conventional washing machine equipped with a pulsator.
Figure 2:
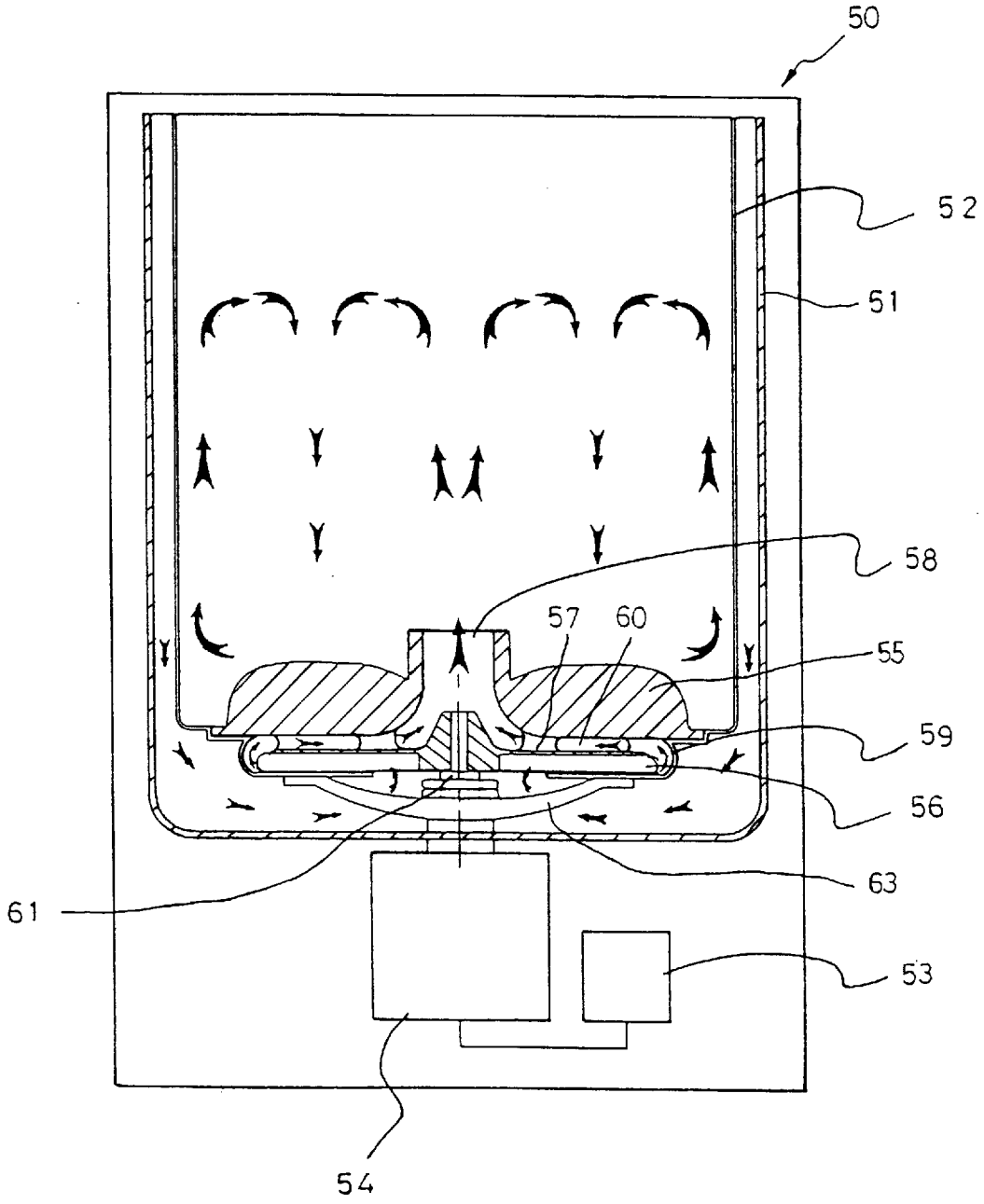
FIG. 2 is a cross-sectional view showing a washing machine equipped with a pulsator to prevent entanglement of laundry being washed of a first embodiment according to the present invention.
Figure 3:
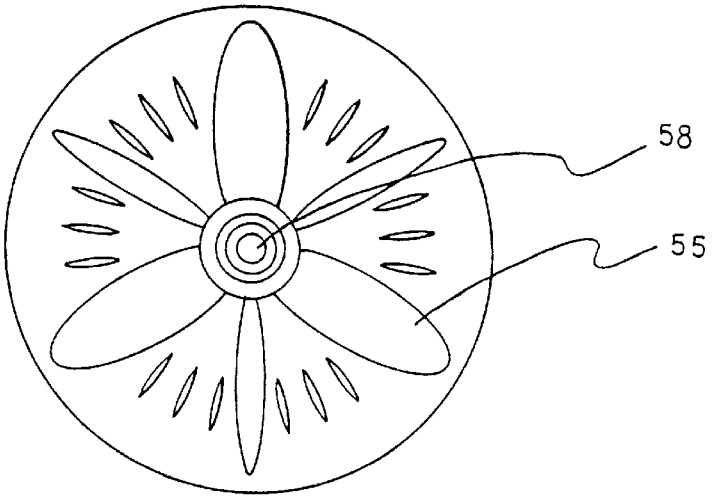
FIG. 3 is a top view of a pulsator showing a washing machine of a first embodiment according to the present invention.
Figure 4:
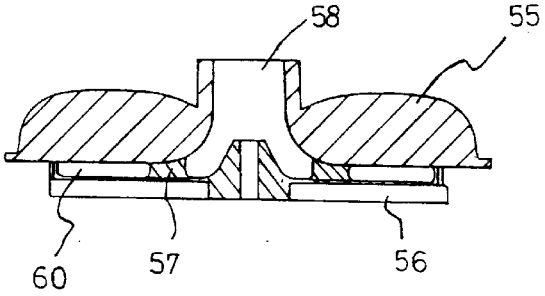
FIG. 4 is a cross-sectional view showing a pulsator of a washing machine of a first embodiment according to the present invention.

Referring to FIGS. 2 through 4, a washing machine equipped with a pulsator to prevent entanglement of laundry of a first embodiment according to the present invention will now be explained.

To begin with, since the construction except the pulsator of the washing machine is the same as the previously described conventional washing machine, only the construction of the pulsator will now be explained.

The pulsator includes an upper blade 55, and a lower blade 56 disposed immediately below the upper blade 55, and a plurality of support bushings 57 disposed between the upper blade 55 and the lower blade 56 for connecting the upper and lower blades 55 and 56 and for transferring a rotation force of the lower blade 56 to the upper blade 55.

In addition, a washing water hole 58 is formed on the central portion of the upper blade 55, and a washing water guide section 59 is formed on the inner surface between the lower blade 56 and the inner surface of the inner tub 52.

In addition, a washing water flow path 60 is formed between the upper blade 55 and the lower blade 56 for guiding the washing water toward the washing water hole 58 and is formed to have a special configuration for reducing a liquid flowing resistance.

The operation of a washing machine equipped with a pulsator to prevent entanglement of laundry of a first embodiment according to the present invention will now be explained with reference to the accompanying drawings.

To begin with, when the washing machine is driven, the pulsator rotates together with the upper blade 55 and the lower blade 56 in the reverse direction or in the normal direction by receiving a driving force from the motor 53 and the clutch 54.

Figure 5:
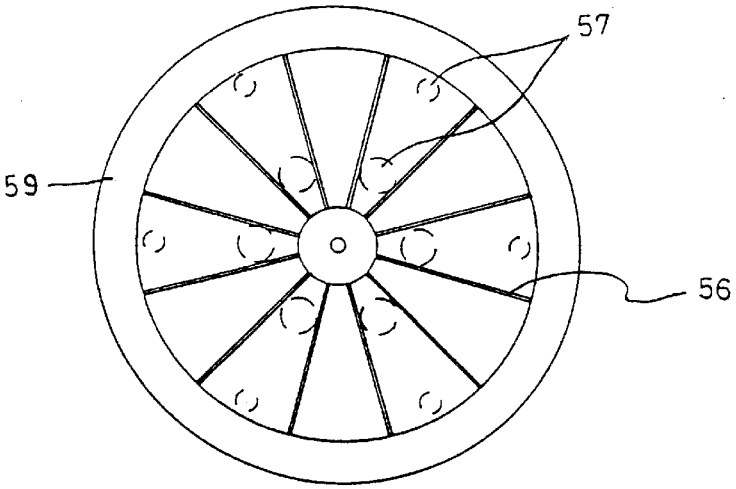
FIG. 5 is a bottom view showing a pulsator of a washing machine of a first embodiment according to the present invention.

Therefore, the washing water forcibly goes up along the inner circumferential surface of the inner tub 52 by a centrifugal force of the upper blade 55, and at the same time, the washing water flows toward the washing water guide section 59, as shown in FIG. 5, by a rotation force of the lower blade 56 and goes up in the inner tub 52 through the washing water flow path 60 and the washing water hole 58.

Therefore, a certain water pillar having a predetermined height is formed at the central portion within the inner tub 52 due to the pressure of the washing water gushed from the washing water hole 58, so that the gathering of laundry toward the central portion of the inner tub 52 is prevented, thereby preventing the entanglement of laundry.

In addition, with the above-described constructions, during the washing and rinsing operation, the laundry in the inner tub comes into contact with the inner circumferential surface of the inner tub more often compared with the prior art, so that a desired washing effect can be achieved.

Figure 6:
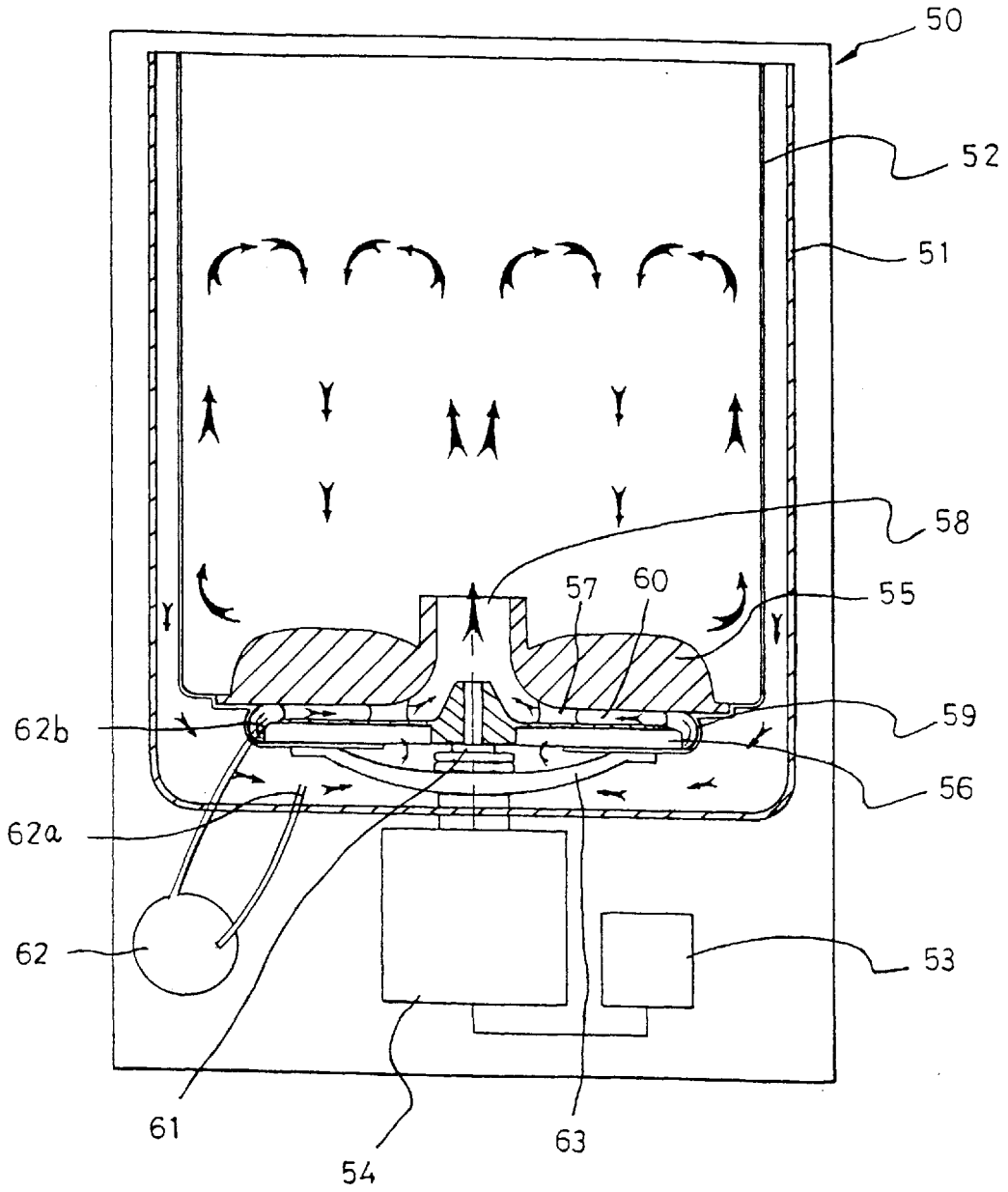
FIG. 6 is a cross-sectional view showing a washing machine equipped with a pulsator to prevent entanglement of laundry of a second embodiment according to the present invention.

Referring to FIG. 6, a washing machine equipped with a pulsator to prevent entanglement of laundry of a second embodiment according to the present invention will now be explained.

To begin with, since the construction of the second embodiment is similar to that of the first embodiment, only the different construction will now be explained.

The washing machine equipped with a pulsator to prevent entanglement of laundry of the second embodiment is directed to providing a pump 62 disposed at the lower surface of the lower surface of the inner tub 52 so as to enhance a washing water ejecting performance of the washing water hole formed at the central portion of the pulsator.

Here, a washing water suction port 62 of the pump 62 is connected to a predetermined portion of the bottom of the outer tub 51, and a washing water ejecting port 62 of the pump 62 is connected to a predetermined portion of a periphery between the upper blade 55 and the lower blade 56 so as to most effectively ejecting the washing water toward the washing water hole 58.

In drawings, reference numeral 63 denotes an inner tub supporting frame.

Figure 7:
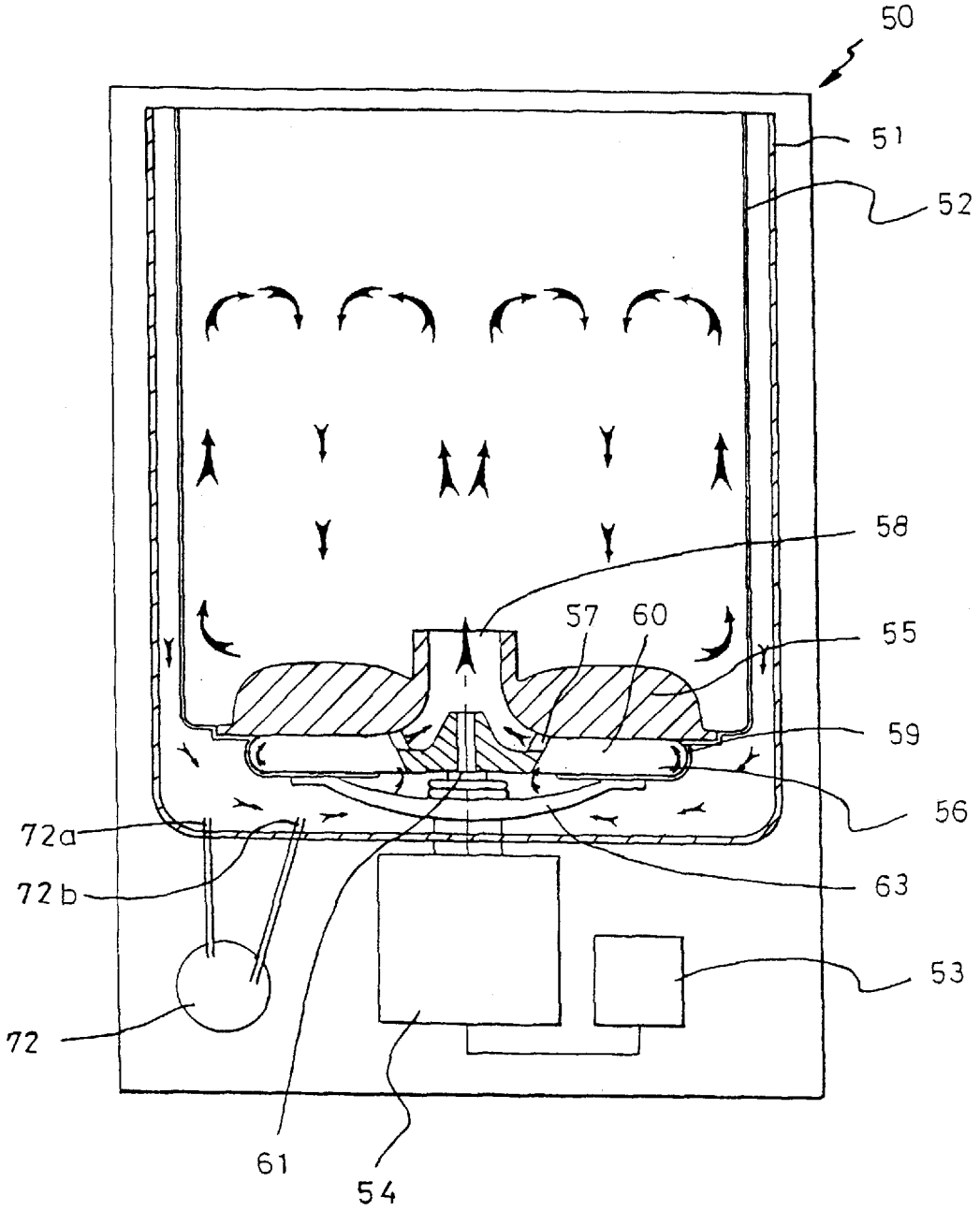
FIG. 7 is a cross-sectional view showing a washing machine equipped with a pulsator to prevent entanglement of laundry of a third embodiment according to the present invention.

Referring to FIG. 7, a washing machine equipped with a pulsator to prevent entanglement of laundry of a third embodiment according to the present invention will now be explained.

To begin with, since the construction of the third embodiment is similar to that of the second embodiment, only the different construction will now be explained.

The washing machine equipped with a pulsator to prevent entanglement of laundry of the third embodiment according to the present invention is directed to providing a lower blade 56 smaller than that of the first and second embodiments and a washing water ejecting port 72b of the pump 72 below the lower blade 56.

Here, the size of the lower blade 56 and the mounting position of the washing water ejecting ports 62*a* and 72*a* of the pump of the second embodiment and the third embodiment according to the present invention are not limited to its implementation scope of the present invention. That is, in order to enhance the performance of preventing the entanglement of laundry, the above-mentioned features is not limited to its position and size.

As described above, the washing machine equipped with a pulsator of the second and third embodiment according to the present invention is directed to minimizing the entanglement of laundry and enhancing the washing effect by providing the above-mentioned improved features.

Figure 8:
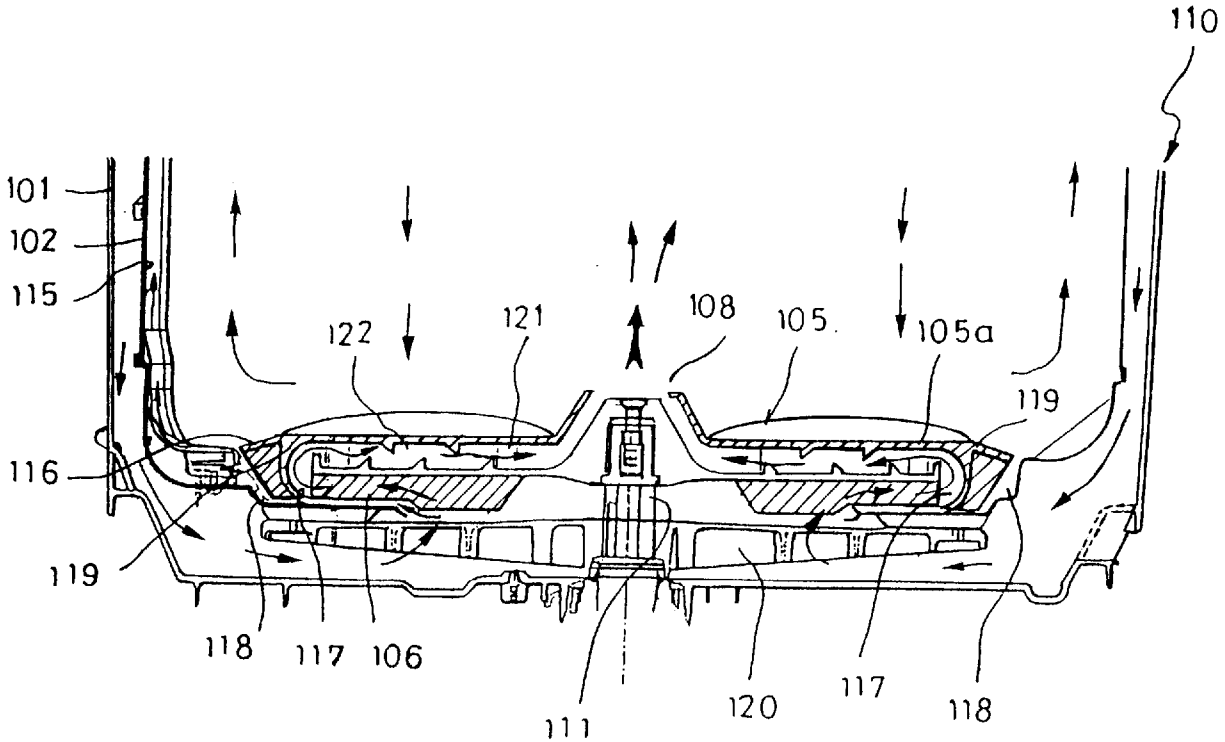
FIG. 8 is a cross-sectional view showing a washing machine equipped with a pulsator to prevent entanglement of laundry of a fourth embodiment according to the present invention.

Referring to FIG. 8, a washing machine equipped with a pulsator to prevent entanglement of laundry of a fourth embodiment according to the present invention will now be explained.

To begin with, since the construction of the fourth embodiment is similar to that of the third embodiment except the pulsator, only the pulsator will now be explained.

As shown therein, the pulsator includes a circular upper blade 105, a circular lower blade 106 disposed below the upper blade 105 and spaced apart from the upper blade 105 so as to form an upper portion washing water flow path 117, and a plurality of support bushings 121 disposed between the upper blade 105 and the lower blade 106 for connecting the upper blade 105 and the lower blade 106 and for transferring a rotation force of the lower blade 106 to the upper blade 105.

In addition, a washing water flow section 119 is extended to the central portion of the lower surface of the lower blade 106, and a plurality of libs 116 integral with the lower surface of the washing water flow section 119 from its outermost portion to its end of the inner portion.

In addition, an upwardly extending silk collecting tunnel 115 is formed on the inner circumferential surface of the inner tub 102, and a washing water ejecting hole 108 is formed at the central portion of the pulsator.

An outer portion washing water flow path 118 is formed on the inner circumferential portion of the inner tub 102 between the libs 116 for supplying washing water to the silk collecting tunnel 115.

Therefore, the upper portion washing water flow path 117 and the outer portion washing water flow path 118 are distinctively defined by the washing water flow section 119.

The operation of the washing machine equipped with a pulsator to prevent entanglement of laundry of the fourth embodiment according to the present invention will now be explained with reference to the accompanying drawings.

When the washing machine is driven, the pulsator with the upper blade 105 and the lower blade 106 rotate in the reverse direction or in the normal direction by receiving a driving force from the motor (not shown) and the clutch (not shown).

Therefore, the washing water gushes upwards by the centrifugal force of the upper blade 105 along the inner circumferential surface of the lower blade 106, and at the same time, the washing water flowing into the upper portion washing water flow path 117 is ejected into the inner tub 102 through the ejecting hole 108.

When the lower blade 106 rotates, the washing water forcibly flows toward the silk collecting tunnel 115 through the outer portion washing water path 118 by the pressure which occurs by the libs 116, thus effectively collecting silk and the like.

Reference numeral 101 in the drawings is an outer tub 101, and 120 is an inner tub supporting frame.

As described above, the washing machine equipped with a pulsator to prevent entanglement of laundry of the present invention is directed to preventing entanglement of laundry by providing an upper washing water ejecting path formed inside the pulsator and an ejecting hole formed at the central portion of the upper blade so that the washing water is ejected from the ejecting hole, thus forming a certain water flowing pillar at the central portion inside the inner tub. In addition, the washing water flows into the silk collecting tunnel, so that unnecessary foreign matters are filtered thereby.

What is claimed is:

1. A washing machine equipped with a pulsator to prevent entanglement of laundry, comprising:

an upper blade having a upwardly extending ejection hole, said upwardly extending ejection hole being formed at a central portion of said upper blade;

a lower blade disposed below the upper blade;

an improved pulsator disposed between the upper blade and said lower blade for transferring a driving force from the lower blade to the upper blade and having a plurality of spaced-apart support bushings for forming a washing water flow path between the upper blade and the lower blade;

an inner tub having a washing water guide section formed at a periphery of the lower blade and the support bushings; and pumping means disposed at a predetermined portion of said inner tub for pumping washing water to the ejecting hole.

2. The washing machine of claim 1, wherein said pumping means is disposed at an inner portion of the washing water flow path disposed at a periphery of the lower blade.

3. The washing machine of claim 1,wherein said washing water ejecting port is disposed at a lower portion of the lower blade.

4. A washing machine equipped with a pulsator to prevent entanglement of laundry, comprising:

an upper blade having an ejecting hole formed at its central portion;

a lower blade disposed below said upper blade;

a plurality of support bushings disposed between the upper blade and said lower blade for connecting the upper and lower blades and for transferring a driving force from the lower blade to the upper blade and spaced apart so as to form an upper portion washing water flow path between the upper blade and the lower blade; and a washing water flow section formed at a lower portion of an outer periphery of the upper blade and extended to a lower central portion of the lower blade;

wherein said pulsator includes a plurality of ribs integrally formed with the lower surface of the washing water flow section extending from the outermost lower portion of the upper blade and the inner end portion of the washing water flow section.

* * * * *